United States Patent [19]

Moreland

[11] 4,304,084

[45] Dec. 8, 1981

[54] METHOD OF CONSTRUCTING A BUILDING

[76] Inventor: Frank L. Moreland, 904 Boland, Fort Worth, Tex. 76107

[21] Appl. No.: 78,142

[22] Filed: Sep. 24, 1979

[51] Int. Cl.[3] ..... E04G 21/00

[52] U.S. Cl. ..... 52/742; 264/32; 264/34; 264/314; 52/2; 405/266

[58] Field of Search ..... 52/2, 741, 742, 169.1; 264/314, 31, 32, 34; 405/266

[56] References Cited

U.S. PATENT DOCUMENTS 2,624,931 1/1953 Billner ..... 264/34

3,223,759 12/1965 Williamson ..... 52/2

3,651,180 3/1972 Glueckert ..... 264/314

*Primary Examiner*—John E. Murtagh

*Attorney, Agent, or Firm*—James E. Bradley

[57] ABSTRACT

A method for constructing a building utilizes flexible bags. An outer bag is inflated, and structural material poured through the bag's inlet to define the floor. An inner bag, smaller than the outer bag, is inflated inside the outer bag. Structural material is poured into the space between the inner and outer bags, which are preferably supported by water and air pressure. This defines the walls and roof of the building. Once the structural material has set, the inner bag may be removed and used for further construction.

5 Claims, 2 Drawing Figures

METHOD OF CONSTRUCTING A BUILDING

BACKGROUND OF THE INVENTION

1. Field of the Invention

This invention relates in general to building construction methods, and in particular to a method of constructing a building particularly adapted for heavy loading such as being covered by earth.

2. Description of the Prior Art

Due to high energy costs, earth covered buildings are becoming increasingly popular. Typically an earth covered building is constructed by excavating into a hillside or into a level area to a partial depth of the building. The cement floors, walls and ceilings are poured by a conventional forming technique. All joints must be carefully sealed to avoid later leakage. Subsequently, the structure is covered by earth, usually on three sides.

Because of the high labor and material costs, an earth covered residence may be more expensive than a conventional frame residence. A need exists for low cost housing in general, and particularly for low cost earth covered structures.

SUMMARY OF THE INVENTION

It is accordingly the general object of this invention to provide an improved method of constructing a building.

It is a further object of this invention to provide an improved method of constructing a building, particularly adapted for heavy loading such as being covered by earth or submerged in the sea.

In accordance with these objects, a new method of construction is provided that includes the step of providing a large outer bag and at least one inner bag of flexible, water tight material. Each bag has a closed bottom and walls that curve inwardly to a neck and inlet at the top. The outer bag is first inflated with its bottom on the earth's surface. A structural material such as concrete is poured into the outer bag to form the floor of the structure. The inner bag is then inflated inside the outer bag. The inner bag is smaller than the outer bag, defining a wall space between its walls and the walls of the outer bag. A structural material is poured into this space while positive air pressure is maintained inside the inner bag. Once set, this defines the walls and roof of the structure.

The walls may be poured in two stages, with a water level being provided in the inner bag during the pouring of the lower portion of the walls. The water is subsequently drained and the inner bag removed. The outer bag remains over the exterior and serves as a moisture barrier. If the structure is to be earth covered, earth is then placed on the top and normally three sides.

DESCRIPTION OF THE PREFERRED EMBODIMENT

Figure 1:
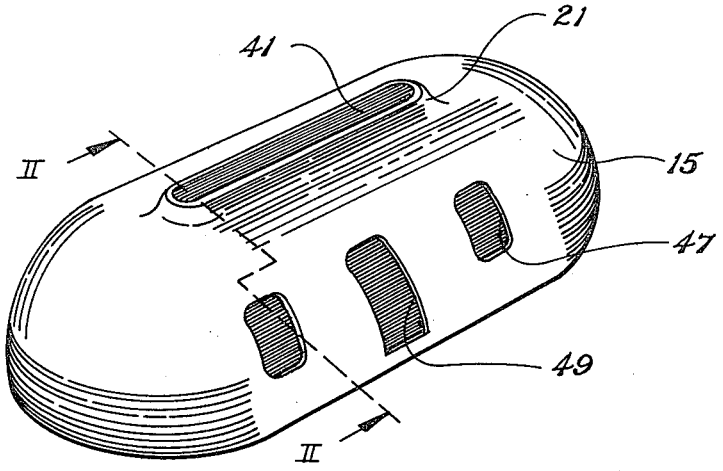
FIG. 1 is a perspective view of a building structure constructed in accordance with this invention.
Figure 2:
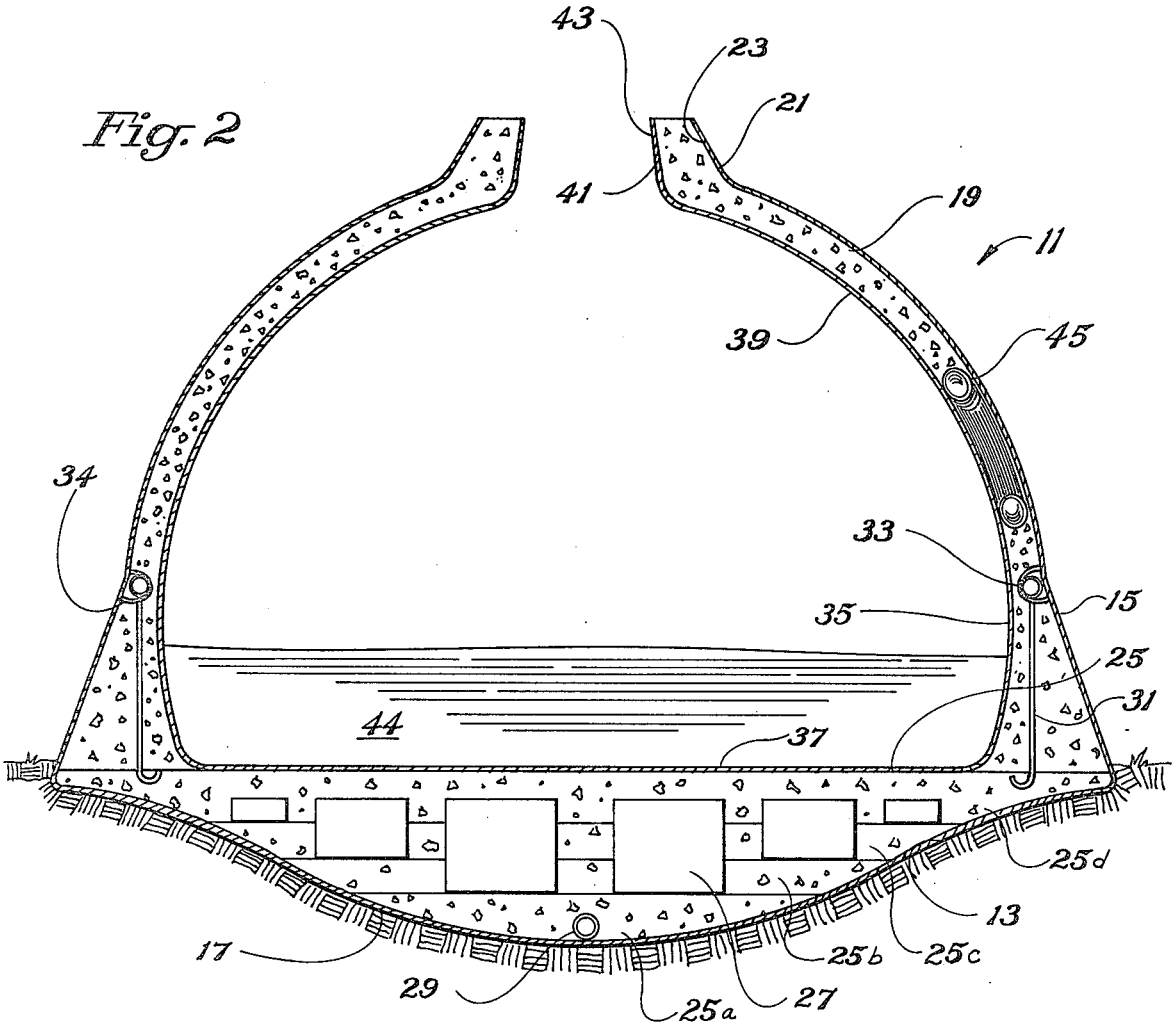
FIG. 2 is a sectional view of the building structure of FIG. 1 taken along the line II—II of FIG. 1.

Referring to FIG. 2, structure 11 is schematically shown. Structure 11 is located in an excavated basin 13. Basin 13 may have gradually sloping sides and is preferably elongated as shown in FIG. 1, although it could also be circular or other shapes. Basin 13 is in the general shape of a semicylindrical trough with circular ends, though other shapes are feasible.

An outer bag 15 of flexible airtight and watertight material is suspended over basin 13. Preferably outer bag 15 is of structural fabric that is substantially nonstretchable. Outer bag 15 has a closed bottom 17 that substantially covers basin 13. Outer bag 15 has walls 19 that extend upwardly and curve inwardly toward each other, terminating in a neck portion 21 at the top that has an elongated inlet 23. When inflated, outer bag 15 is generally semicylindrical in configuration with rounded ends. Various types of devices may be used to inflate and support outer bag 15.

After outer bag 15 is positioned in basin 13, a concrete floor 25 and anchoring system is provided. The floor 25 may be poured in separate layers through the inlet 23 of the outer bag 15 onto the bottom 17 of the outer bag 15. Each layer is allowed to set before pouring the next layer. Layer **25*a* is the lowermost layer. Spacer blocks 27 are placed on level 25*a* as level 25*b* is poured, to conserve the amount of concrete required. Spacer blocks 27 may be rectangular, rigid, blocks of impermeable material such as plastic. Other spacer blocks 27 are positioned in levels 25*c* and 25*d*. Alternately, the floor 25 could be poured in a single pouring with spacer blocks 27 strapped down to prevent flotation. While pouring the floor 25, conduits, indicated schematically as 29, are placed in the floor for utilities such as water, drainage, gas, and electricity. A drain (not shown) is also preferably installed for draining water from floor 25**, which has a flat upper surface.

While pouring upper layer **25*d*, a plurality of anchors 31 are positioned around the periphery of the outer bag 15 and spaced inwardly a short distance. Anchors 31 are vertical rods extending upwardly a selected distance, commonly 2½ feet from the top of floor 25. Anchors 31 are spaced about 3 feet apart and preferably braced by inclined beams (not shown) to prevent them from bending outwardly. An equator bar or pipe 33 is secured by welding or otherwise to the tops of anchors 31. Equator bar 33 extends around the entire perimeter. The inside wall of outer bag 15 is drawn tightly to the equator bar 33 and secured by straps 34** or other attachment means.

After floor 25 has hardened or set, an inner bag 35 is lowered through the outer bag inlet 23 and inflated by air pressure. Inner bag 35 may be of the same general type material as outer bag 15, but normally would be thicker and tougher. Inner bag 35 is flexible, airtight, and watertight. Inner bag 35 has a closed bottom 37 and walls 39 that converge inwardly into a neck 41 with an inlet 43 at the top. Inner bag 35 may be of the same general shape as outer bag 15, but is of slightly lesser dimensions. When both are fully inflated, a space, say, about 3 to 8 inches, exists between the wall 19 and wall 39 for defining the walls and roof of the building 11. Although not necessary, spacer elements could be located at various points between the walls 19 and 39 to assure that the wall thickness remains as desired.

Once inflated, water, indicated by numeral 44, is poured through inner bag inlet 43, covering the bottom of inner bag 35 to a depth adequate to prevent concrete from moving inward when poured between the walls of inner bag 35 and outer bag 15. The water depth depends on the weight of the concrete slurry and the desired height of the first layer or portion of the wall. The water depth must be sufficient to provide a hydrostatic pressure at all levels greater than the hydrostatic pressure exerted at the same levels by the concrete slurry.

The lower edge of outer bag 15 is secured in place by the concrete floor 25. Equator bar 33 secures a second position on the outer bag 15, for providing retaining support. The inner bag 35 and outer bag 15 thus define a substantially rigid form up to equator bar 33. A clearance exists between the inner bag 35 and the equator bar 33 to allow the passage of concrete. Concrete is then poured through outer bag inlet 23 between the walls 19 and 39 to a level approximately equal to equator bar 33. This first or lower wall portion is allowed to set prior to pouring the second wall portion.

Templates 45 are tightly wedged at various points in the space between the inner bag 35 and outer bag 15 for window openings 47 and a door opening 49, as shown in FIG. 1. Each template 45 is a blocking device for preventing concrete from flowing through the area that it is sealing. A template 45 for a round window could be an inner tube. The door opening 49 could be located above equator bar 33, or a vacant portion could be left in the equator bar 33 for the door opening 49.

After the lower wall portion has set, concrete is poured through outer bag inlet 23 between the walls of outer bag 15 and inner bag 35 until it reaches the level of the top of the bags, as shown in FIG. 2. During the pouring, approximately 3 to 15 psig (pounds per square inch gage) of air pressure should be maintained in the inner bag 35. The amount of pressure should be sufficient to hold the weight of the concrete, thus the precise air pressure required depends upon the wall thickness and concrete density. Neck portions 21 and 41 are restrained by a supporting structure (not shown) during pouring. Once this upper wall portion has set, the air pressure is released. Water 44 can be drained at this time or immediately after the setting of the lower wall portion. The inner bag 35 can be withdrawn and reused in the construction of another structure, or it can remain inside as an inner wall liner. Holes are cut in the outer bag 15 at templates 45 for windows and doors, and the templates are removed. The outer bag 15 remains as the outer layer of the building structure 11, providing sealing against moisture.

FIG. 2 discloses the configuration of the structure after the concrete has set. The structure 11 has a semicylindrical roof that curves down to form walls. If the building is to be an earth covered structure, a concrete overhang (not shown) is poured as well as a door entryway. Earth is placed on the top of the overhang and on at least three sides. Vent pipes pass through the opening at the top, which will usually be fitted with a skylight. Partitions and cabinets can be constructed conventionally in the structure.

It should be apparent than an invention having significant improvements has been provided. The construction is fast and requires little labor since conventional forms are not required. The outer bag provides sealing. There are no joints that need to be sealed. The method provides a long lasting energy efficient structure that requires little maintenance.

The method could be utilized in constructing structures for location beneath the sea. In that case, the structure could be constructed in the sea. The floor would provide sufficient weight to submerge the outer bag. The hydrostatic pressure in the sea would exert sufficient force to avoid an equator bar while pouring the walls. The inflated inner bag would provide the inner form for the walls and roof as described above.

While the invention has been shown in only one of its forms, it should be apparent that the invention is not so limited but is susceptible to various changes and modifications without departing from the spirit thereof. For example, two or more inner bags could be used in a single outer bag. The inner bags could be generally circular and placed adjacent each other, resulting in an inner support partition. Also, rather than concrete, other types of structural materials or slurries in general could be used such as plastic materials, or concrete with fiberglass whiskers and plastisizers.

I claim:

1. A method of constructing a building comprising:

supporting an outer bag of a type having a bottom and inwardly curving walls;

pouring structural material into the bottom of the outer bag to define a floor;

inflating an inner bag inside the outer bag after the structural material of the floor hardens, the inner bag being of smaller dimensions than the outer bag;

pouring structural material through the space between the inner bag and outer bag to define walls and a roof for the building after the structural material hardens;

erecting an equator bar to extend around the perimeter of the outer bag a selected distance from the floor, prior to pouring the walls; and pouring a first wall portion from the floor to the equator bar prior to pouring the remainder of the wall.

2. A method of constructing a building comprising:

providing an outer bag of flexible substantially airtight material, with a closed bottom and walls that curve inwardly to a neck with an inlet at the top;

supporting the outer bag upright with its bottom in contact with the earth;

pouring structural material into the bottom of the outer bag to define a floor;

lowering an inner bag through the inlet after the structural material of the floor hardens, the inner bag being of flexible substantially airtight material with a closed bottom and walls that curve inwardly to a neck with an inlet at the top;

pouring a liquid into the inner bag to a selected level so that the bottom of the inner bag is supported on the floor; then pumping air into the inlet of the inner bag to inflate the inner bag, the inner and outer bags being dimensioned so that when both are inflated, a space exists between the walls of the inner and outer bags; then pouring structural material into the space between the inner and outer bags to define the wall and roof of the building when hardened, while air pressure is maintained in the inner bag; then releasing the air pressure inside the inner bag;

removing the liquid from the inner bag; and removing the inner bag.

3. A method of constructing a building, comprising:

providing an outer bag and an inner bag, each bag being of flexible, substantially watertight material with a closed bottom and walls that curve inwardly to a neck with an inlet at the top;

excavating a basin in the earth;

supporting the outer bag with its bottom in contact with the basin and its inlet above the earth's surface;

pouring structural material through the inlet of the outer bag into the bottom of the outer bag to define a floor with a flat upper surface when hardened;

supporting an equator bar horizontally above the floor and inside the outer bag so that it defines the perimeter of the building, and securing the outer bag to the equator bar;

lowering the inner bag through the inlet of the outer bag and inflating it with its bottom surface on the floor, after the structural material of the floor has hardened, the inner bag being of lesser dimensions than the outer bag, defining a space between the walls of the inner bag and outer bag when both are inflated;

pouring water into the inner bag to a selected level;

locating a template in the space between the walls of the inner bag and outer bag of dimensions that of a desired opening, the template fitting tightly between the walls of the inner bag and outer bag to prevent the intrusion of structural material into the area that it defines;

pouring structural material through the outer bag inlet into the space between the walls of the inner bag and outer bag to define a first wall portion of height selected so that the hydrostatic pressure of the structural materia while pouring is less than the hydrostatic pressure of the water at the same level;

pouring structural material through the outer bag inlet into the space between the walls of the inner bag and outer bag above the first wall portion, after the first wall portion has hardened, to define the walls and roof of the building, while maintaining a positive air pressure inside the inner bag;

removing the water; and removing the inner bag after the structural material above the first wall portion has hardened.

4. The method according to claim 3 wherein spacer blocks are placed in the floor during pouring of the structural material to conserve structural material.

5. A method of constructing a building comprising:

providing an outer bag of flexible substantially airtight material, with a closed bottom and walls that curve inwardly to a neck with an inlet at the top;

supporting the outer bag upright with its bottom in contact with the earth;

placing a structural material means into the bottom of the outer bag for defining a floor;

lowering an inner bag through the inlet, the inner bag being of flexible substantially airtight material with a closed bottom and walls that curve inwardly to a neck with an inlet at the top;

pouring a liquid into the inner bag to a selected level so that the bottom of the inner bag is supported on the structural material means; then pumping air into the inlet of the inner bag to inflate the inner bag, the inner and outer bags being dimensioned so that when both are inflated, a space exists between the walls of the inner and outer bags; then pouring structural material into the space between the inner and outer bags while air pressure is maintained in the inner bag; then releasing the air pressure inside the inner bag;

removing the liquid from the inner bag; and removing the inner bag.

* * * * *